US012624532B2

(12) United States Patent
Ou et al.

(10) Patent No.: US 12,624,532 B2
(45) Date of Patent: May 12, 2026

(54) DISASSEMBLY AND ASSEMBLY STRUCTURE OF FAUCET

(71) Applicant: KAIPING YIZHAN VALVE CORE CO., LTD., Kaiping (CN)

(72) Inventors: Jieci Ou, Kaiping (CN); Xianbing Shi, Kaiping (CN); Junfa Shen, Kaiping (CN)

(73) Assignee: KAIPING YIZHAN VALVE CORE CO., LTD., Kaiping (CN)

( * ) Notice: Subject to any disclaimer, the term of this patent is extended or adjusted under 35 U.S.C. 154(b) by 196 days.

(21) Appl. No.: 18/509,673

(22) Filed: Nov. 15, 2023

(65) Prior Publication Data

US 2025/0075472 A1 Mar. 6, 2025

(30) Foreign Application Priority Data

Sep. 4, 2023 (CN) ..... 202322396392.5

(51) Int. Cl.
*E03C 1/04* (2006.01)

(52) U.S. Cl.
CPC ..... *E03C 1/0403* (2013.01); *E03C 1/04* (2013.01); *E03C 2001/0417* (2013.01)

(58) Field of Classification Search
CPC ... E03C 1/04; E03C 1/0403; E03C 2001/0417
See application file for complete search history.

(56) References Cited

FOREIGN PATENT DOCUMENTS

CN 112747141 A * 5/2021 ..... F16K 31/0675
WO WO-2019144873 A1 * 8/2019 ..... E03C 1/0405

* cited by examiner

*Primary Examiner* — Jennifer C Chiang
(74) *Attorney, Agent, or Firm* — Westbridge IP LLC

(57) ABSTRACT

A disassembly and assembly structure of a faucet includes: an elbow pipe with both ends run through, a side wall of the bottom of the elbow pipe being provided with a clamping hole; a fixed base, provided with an insertion part, the insertion part being inserted into the elbow pipe from an opening at a bottom end of the elbow pipe; a clamping piece, rotationally installed on the insertion part of the fixed base, the clamping piece including an elastic buckle, the elastic buckle being clamped into the clamping hole when the insertion part of the fixed base is inserted into the elbow pipe to reach a preset position, when the elbow pipe rotates relative to the fixed base, the elbow pipe actuating the clamping piece to rotate relative to the fixed base.

9 Claims, 8 Drawing Sheets

DISASSEMBLY AND ASSEMBLY STRUCTURE OF FAUCET

CROSS-REFERENCE TO RELATED APPLICATIONS

This application claims priority to Chinese Patent Application No. 202322396392.5, filed on Sep. 4, 2022, which is incorporated herein by reference in its entirety.

TECHNICAL FIELD

The application relates to a disassembly and assembly structure of a faucet.

BACKGROUND

At present, kitchen faucets on the market are generally provided with an elbow pipe and a fixed base, and the elbow pipe is connected to the fixed base. However, after the elbow pipe is connected to the fixed base, the whole faucet is larger in size and higher in packaging and transportation costs. Therefore, in some related art, the elbow pipe and the fixed base of the faucet are separated and not assembled together for shipment, and when a user installs the faucet, the elbow pipe and the fixed base are assembled together, which may greatly reduce the packaging and transportation costs. However, in the related art, the disassembly and assembly structure of the elbow pipe and the fixed base is often complex, and the assembly is not convenient enough.

SUMMARY

The application aims at providing a disassembly and assembly structure of a faucet, which is simple and easy to disassemble and assemble an elbow pipe and a fixed base.

In order to achieve the above objective, the application adopts the following technical solution.

A disassembly and assembly structure of a faucet includes an elbow pipe, a fixed base, and a clamping piece.

The elbow pipe is provided with both ends run through, and a side wall of the bottom of the elbow pipe is provided with a clamping hole.

The fixed base is provided with an insertion part, and the insertion part is inserted into the elbow pipe from an opening at a bottom end of the elbow pipe.

The clamping piece is rotationally installed on the insertion part of the fixed base, and includes an elastic buckle. The elastic buckle is clamped into the clamping hole when the insertion part of the fixed base is inserted into the elbow pipe to reach a preset position, and when the elbow pipe rotates relative to the fixed base, the elbow pipe actuates the clamping piece rotates relative to the fixed base.

According to the disassembly and assembly structure of the faucet of the application, the fixed base is provided with the insertion part, the insertion part is inserted into the elbow pipe from the opening at the bottom end of the elbow pipe, the side wall of the bottom of the elbow pipe is provided with the clamping hole, the clamping piece is further provided, the clamping piece is rotationally installed on the insertion part of the fixed base, and includes the elastic buckle, which is clamped into the clamping hole when the insertion part of the fixed base is inserted into the elbow pipe to reach the preset position, so that the fixed base and the elbow pipe are relatively rotationally connected, the structure is simple, and during disassembly, it is only necessary to drive the elastic buckle to make the elastic buckle exit the clamping hole, and the elbow pipe and the fixed base are easily disassembled and assembled.

In a preferred embodiment, the clamping piece further includes a C-shaped connecting ring. An outer peripheral wall of the insertion part of the fixed base is provided with an annular groove, the C-shaped connecting ring is embedded into the annular groove, the C-shaped connecting ring rotates in the annular groove, and the elastic buckle is installed on the C-shaped connecting ring.

In the above solution, the clamping piece includes the C-shaped connecting ring, and is rotationally installed on the fixed base through the C-shaped connecting ring, so that the clamping piece is directly clamped on the fixed base only through the elastic deformation of the C-shaped connecting ring during installation, the clamping piece is installed more simply and quickly, and the clamping piece is also very simple in structure.

In a preferred embodiment, a side wall of the C-shaped connecting ring is provided with an avoiding groove, an elastic piece is formed by a part surrounded by the avoiding groove on the side wall of the C-shaped connecting ring, an outer side of a free end of the elastic piece is provided with a protruding column matched with the clamping hole, and the elastic piece and the protruding column constitute the elastic buckle.

In the above solution, the side wall of the C-shaped connecting ring is provided with the avoiding groove to form the elastic piece, and then constitutes the elastic buckle together with the protruding column, the elastic buckle is simple in structure, and the whole clamping piece is compact in structure.

In a preferred embodiment, an inclined surface is formed on an upper surface of the protruding column, and the bottom end of the elbow pipe abuts against the inclined surface to enable the protruding column to move inward in a radial direction of the insertion part in a process of inserting the insertion part into the elbow pipe.

In the above solution, the inclined surface is arranged on the upper surface of the protruding column, so that the elbow pipe pushes the protruding column to enable the elastic piece to elastically deform, the protruding column moves inward in the radial direction of the insertion part, and then the elbow pipe is smoothly inserted into the fixed base.

In a preferred embodiment, after the insertion part is inserted into the elbow pipe, an inner wall of the elbow pipe restricts the C-shaped connecting ring to exit the annular groove.

In the above solution, the inner wall of the elbow pipe restricts the C-shaped connecting ring to exit the annular groove, so that the connection is more reliable.

In a preferred embodiment, the disassembly and assembly structure further includes a hollow faucet body. A bottom end of the faucet body is fixed to a mounting table surface through a locking assembly, a top end of the faucet body is provided with a through hole, a part of the fixed base is fixed in the faucet body, and the insertion part penetrates out of the faucet body through the through hole.

In a preferred embodiment, a side wall of the faucet body is provided with a mounting hole configured to install a control valve, and a valve core of the control valve penetrates through the mounting hole and is connected to the fixed base.

In the above solution, the valve core of the control valve is directly connected to the fixed base, so that the faucet body is independently arranged relative to the control valve and the fixed base, only the faucet body is made of metal, while the valve core of the control valve and the fixed base may be selected to be made of plastic, which is conducive to saving costs. In addition, because the faucet body is arranged independently, a plurality of faucet bodies with different materials and different appearances are also arranged as required, so that the product design is more flexible.

In a preferred embodiment, an outlet end of the elbow pipe is provided with a drawing head, a drawing water pipe penetrates through the elbow pipe and is connected to the drawing head, the insertion part is sleeve-shaped, an upper end and a lower end of the insertion part are connected to form a channel for allowing the drawing water pipe to pass through.

In a preferred embodiment, a position, located at a bottom end of the insertion part, on an outer peripheral wall of the fixed base is provided with a step surface, a wear-resistant pad is installed on the step surface, and an end surface of the bottom end of the elbow pipe abuts against the wear-resistant pad.

In the above solution, through the arrangement of the wear-resistant pad, the wear to the fixed base caused by the elbow pipe rotating relative to the fixed base is effectively avoided.

In a preferred embodiment, the outer peripheral wall of the insertion part of the fixed base is provided with a sealing ring groove, a sealing ring is installed on the sealing ring groove, and the outer peripheral wall of the insertion part and an inner peripheral wall of the elbow pipe are in sealing fit through the sealing ring.

In the above solution, through the arrangement of the sealing ring, on the one hand, the sealing between the elbow pipe and the fixed base is realized, and on the other hand, the hand feeling of rotating the elbow pipe is better and the use experience is improved.

BRIEF DESCRIPTION OF THE DRAWINGS

In order to make the advantages of the application easier to understand, the application briefly described above will be described in more detail with reference to the specific implementations shown in the drawings. It is to be understood that these drawings depict only typical implementations of the application, and are not considered as limiting the scope of protection thereof, and the application is described and explained by the drawings with additional features and details. In the drawings.

DETAILED DESCRIPTION OF THE EMBODIMENTS

Figure 1:
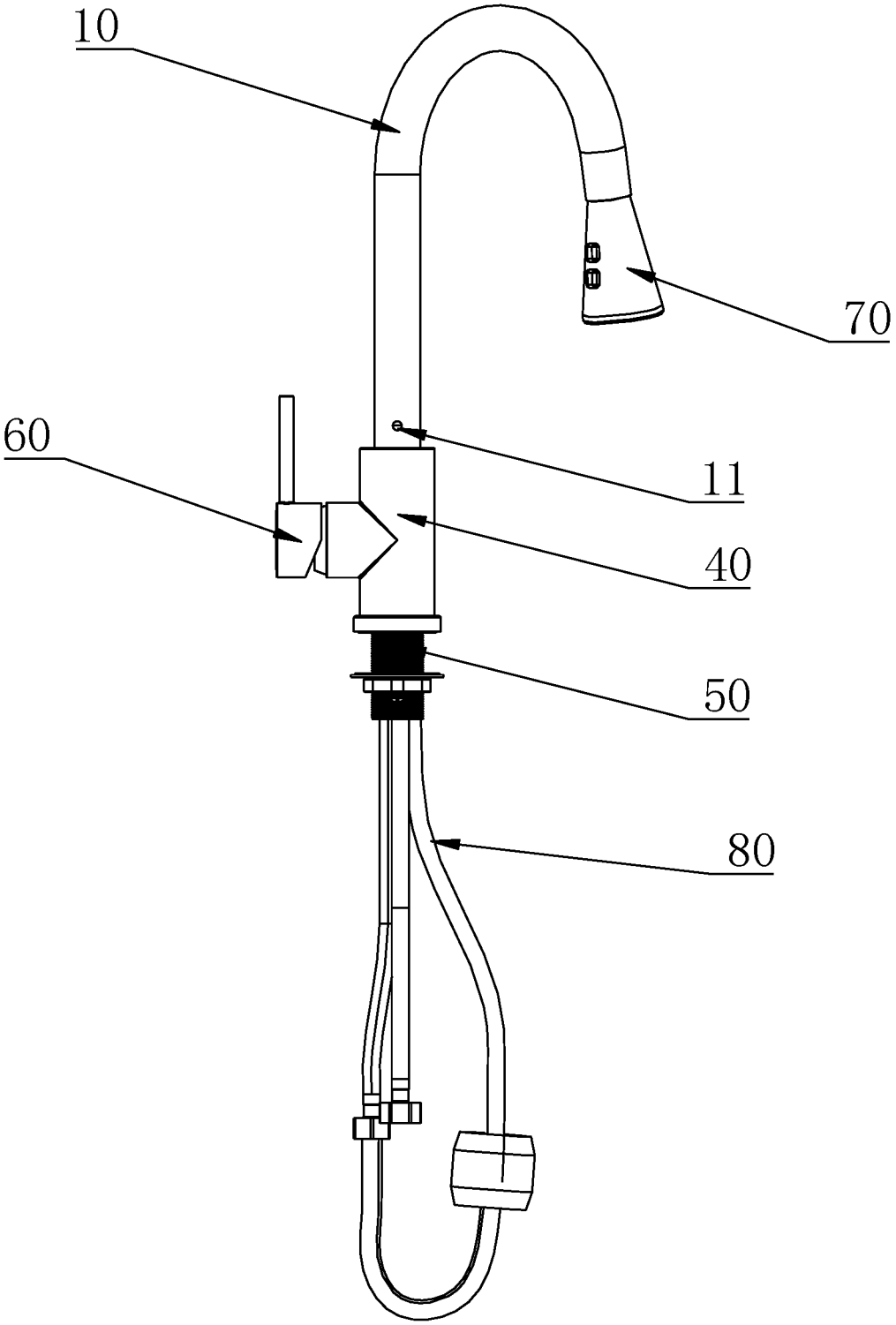
FIG. 1 is a three-dimensional assembly diagram of a disassembly and assembly structure of a faucet of an embodiment of the application.

In order to make the technical problems, technical solutions and beneficial effects to be solved by the application clearer, the application will be further described below in detail in conjunction with the drawings and embodiments. It is to be understood that the specific embodiments described herein are only used to illustrate the application, but are not intended to limit the application.

In the following discussion, details are given to provide a more thorough understanding of the application. However, those skilled in the art may understand that the application may be implemented without one or more of these details. In specific examples, some technical features that are well known in the art are not described in detail in order to avoid confusion with the application. It is to be noted that, the terms "upper", "lower", "front", "rear", "left", "right" and similar expressions used herein are for illustrative purposes only, but not intended to limit the application.

Ordinal numbers such as "first" and "second" referred to in the application are only identifiers and do not have any other meaning, such as a specific order. Moreover, for example, the term "first part" does not imply the existence of "second part" and the term "second part" does not imply the existence of "first part".

Referring to FIG. 1 to FIG. 8, a disassembly and assembly structure of a faucet in a preferred embodiment of the application includes an elbow pipe 10, a fixed base 20, a clamping piece 30, etc. The elbow pipe 10 is provided with both ends run through, and a side wall of the bottom of the elbow pipe 10 is provided with a clamping hole 11. The fixed base 20 is provided with an insertion part 21, and the insertion part 21 is inserted into the elbow pipe 10 from an opening at a bottom end of the elbow pipe 10. The clamping piece 30 is rotationally installed on the insertion part 21 of the fixed base 20, and the clamping piece 30 includes an elastic buckle 31. The elastic buckle 31 is clamped into the clamping hole 11 when the insertion part 21 of the fixed base 20 is inserted into the elbow pipe 10 to reach a preset position. When the elbow pipe 10 rotates relative to the fixed base 20, the elbow pipe 10 actuates the clamping piece 30 rotates relative to the fixed base 20.

The fixed base 20 is provided with the insertion part 21, the insertion part 21 is inserted into the elbow pipe 10 from the opening at the bottom end of the elbow pipe 10, the side wall of the bottom of the elbow pipe 10 is provided with the clamping hole 11, the clamping piece 30 is further provided, the clamping piece 30 is rotationally installed on the insertion part 21 of the fixed base 20, the clamping piece 30 includes the elastic buckle 31, and the elastic buckle 31 is clamped into the clamping hole 11 when the insertion part 21 of the fixed base 20 is inserted into the elbow pipe 10 to reach the preset position, so that the fixed base 20 and the elbow pipe 10 are relatively rotationally connected, the structure is simple, and during disassembly, it is only necessary to drive the elastic buckle 31 to make the elastic buckle 31 exit the clamping hole 11, and the elbow pipe 10 and the fixed base 20 are easily disassembled and assembled.

Figure 2:
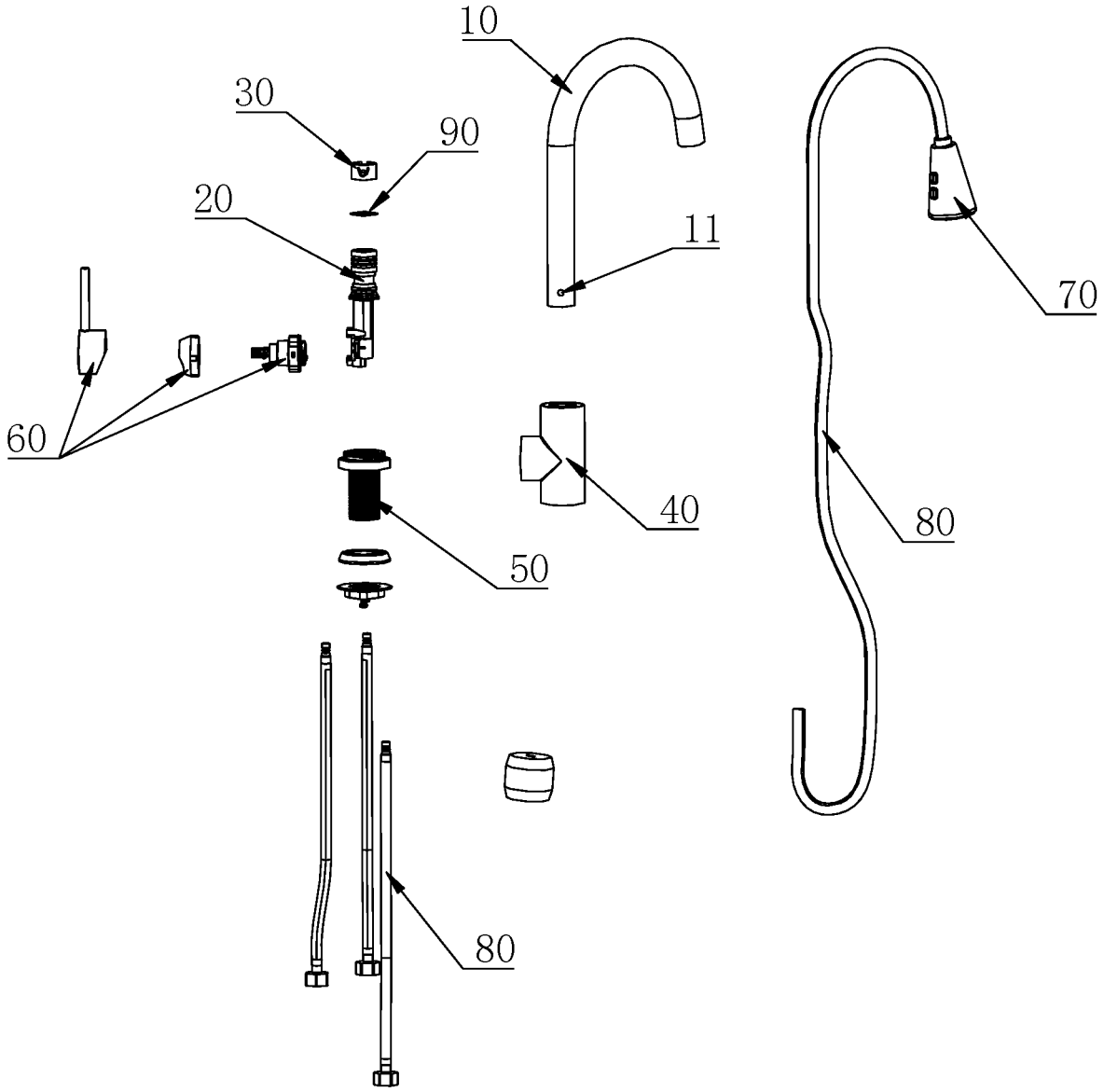
FIG. 2 is a three-dimensional decomposition diagram of a disassembly and assembly structure of a faucet of an embodiment of the application.
Figure 4:
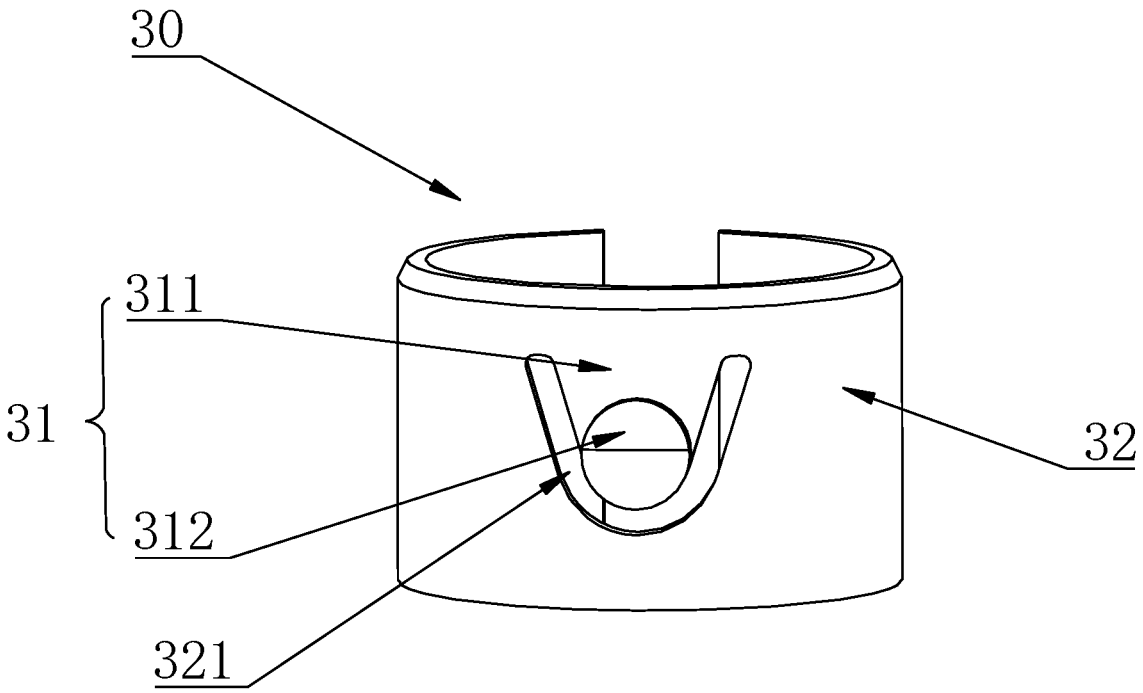
FIG. 4 is a three-dimensional structural diagram of a clamping piece of an embodiment of the application.
Figure 5:
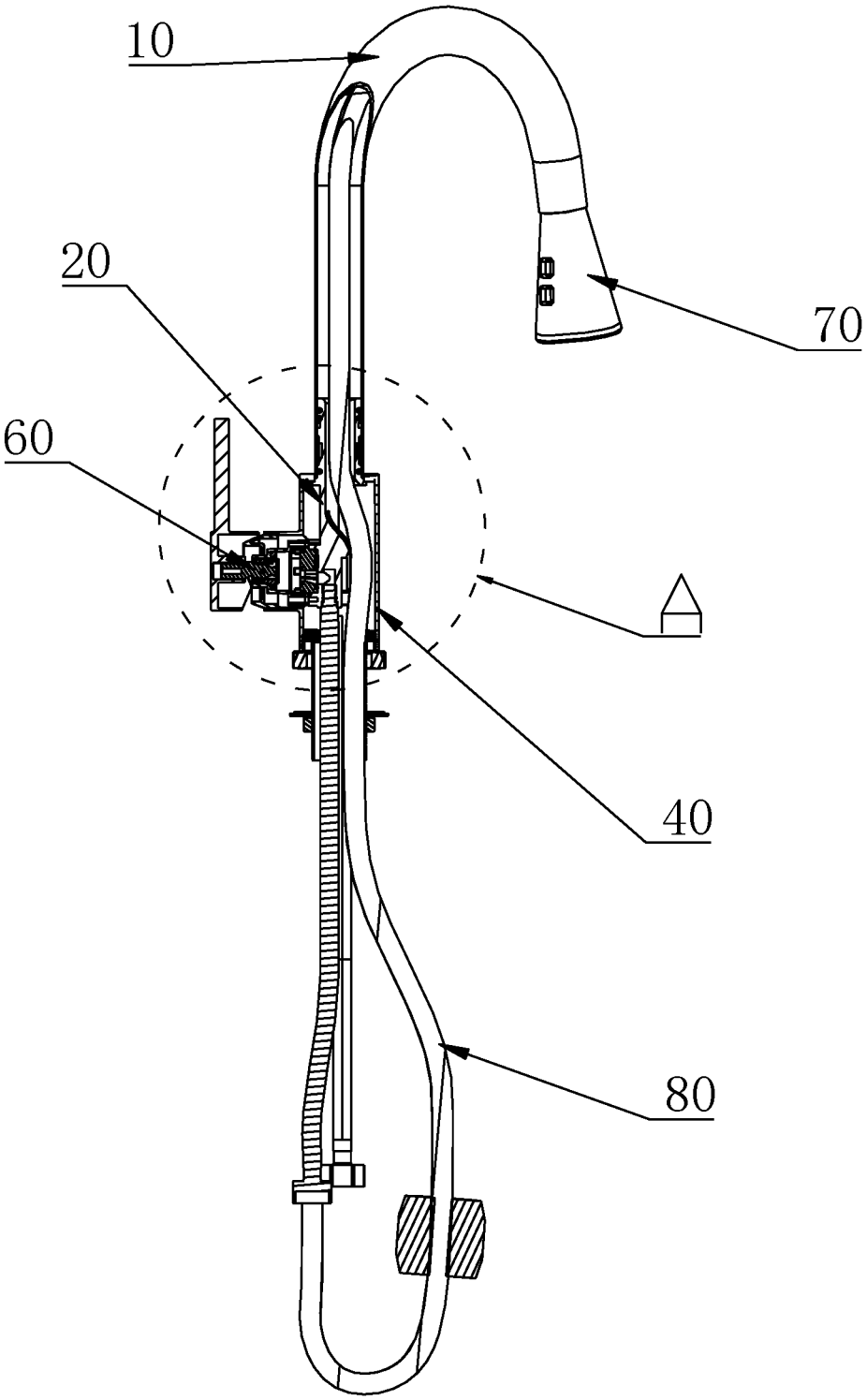
FIG. 5 is a first sectional view of an embodiment of the application.

Referring to FIG. 2 and FIG. 4, in the embodiment, the clamping piece 30 further includes a C-shaped connecting ring 32. An outer peripheral wall of the insertion part 21 of the fixed base 20 is provided with an annular groove 211, the C-shaped connecting ring 32 is embedded into the annular groove 211 and rotates in the annular groove 211, and the elastic buckle 31 is installed on the C-shaped connecting ring 32. Through the design, the clamping piece 30 is directly clamped on the fixed base 20 only through the elastic deformation of the C-shaped connecting ring 32 during installation, the clamping piece 30 is installed more simply and quickly, and the clamping piece 30 is also very simple in structure.

Referring to FIG. 4, in the embodiment, a side wall of the C-shaped connecting ring 32 is provided with an avoiding groove 321, an elastic piece 311 is formed by a part surrounded by the avoiding groove 321 on the side wall of the C-shaped connecting ring 32, an outer side of a free end of the elastic piece 311 is provided with a protruding column 312 matched with the clamping hole 11, and the elastic piece 311 and the protruding column 312 constitute the elastic buckle 31. The side wall of the C-shaped connecting ring 32 is provided with the avoiding groove 321 to form the elastic piece 311, and then constitutes the elastic buckle 31 together with the protruding column 31, the elastic buckle 31 is simple in structure, and the whole clamping piece 30 is compact in structure.

In the embodiment, an inclined surface (not shown in the figure) is formed on an upper surface of the protruding column 312, and the bottom end of the elbow pipe 10 abuts against the inclined surface to enable the protruding column 312 to move inward in a radial direction of the insertion part 21 in a process of inserting the insertion part 21 into the elbow pipe 10. The inclined surface is arranged on the upper surface of the protruding column 312, so that the elbow pipe 10 pushes the protruding column 312 to enable the elastic piece 311 to elastically deform, the protruding column 312 moves inward in the radial direction of the insertion part 21, and the elbow pipe 10 is smoothly inserted into the fixed base 20.

In the embodiment, after the insertion part 21 is inserted into the elbow pipe 10, an inner wall of the elbow pipe 10 restricts the C-shaped connecting ring 32 to exit the annular groove 211. The inner wall of the elbow pipe 10 restricts the C-shaped connecting ring 32 to exit the annular groove 211, so that the connection is more reliable.

In the embodiment, the disassembly and assembly structure further includes a hollow faucet body 40. A bottom end of the faucet body 40 is fixed to a mounting table surface through a locking assembly 50, a top end of the faucet body 40 is provided with a through hole 41, a part of the fixed base 20 is fixed in the faucet body 40, the insertion part 21 penetrates out of the faucet body 40 through the through hole 41, an outer peripheral wall of the fixed base 20 is provided with a spacing ring 23, and the spacing ring 23 abuts against and is limited to an edge of an inner side of the through hole 41, thereby limiting the fixed base 20 in the faucet body 40. Specifically, the locking assembly 50 includes a threaded sleeve with an external thread and a nut matched to the threaded sleeve. The threaded sleeve is in threaded connection with the nut and a bottom end of the faucet body 40, respectively.

Referring to FIG. 1, FIG. 2, FIG. 5 and FIG. 6, in the embodiment, a side wall of the faucet body 40 is provided with a mounting hole 42 configured to install a control valve 60, and a valve core of the control valve 60 penetrates through the mounting hole 42 and is connected to the fixed base 20, thereby limiting and fixing the fixed base 20 in the faucet body 40. The valve core of the control valve 60 is directly connected to the fixed base 20, so that the faucet body 40 is independently arranged relative to the control valve 60 and the fixed base 20, only the faucet body 40 is made of metal, while the valve core of the control valve 60 and the fixed base 20 may be selected to be made of plastic, which is conducive to saving costs. In addition, because the faucet body 40 is arranged independently, a plurality of faucet bodies 40 with different materials and different appearances are also arranged as required, so that the product design is more flexible.

Referring to FIG. 1 and FIG. 2, in the embodiment, an outlet end of the elbow pipe 10 is provided with a drawing head 70, and a drawing water pipe 80 penetrates through the elbow pipe 10 and is connected to the drawing head 70. The insertion part 21 is sleeve-shaped, an upper end and a lower end of the insertion part 21 are connected to form a channel for allowing the drawing water pipe 80 to pass through.

Figure 3:
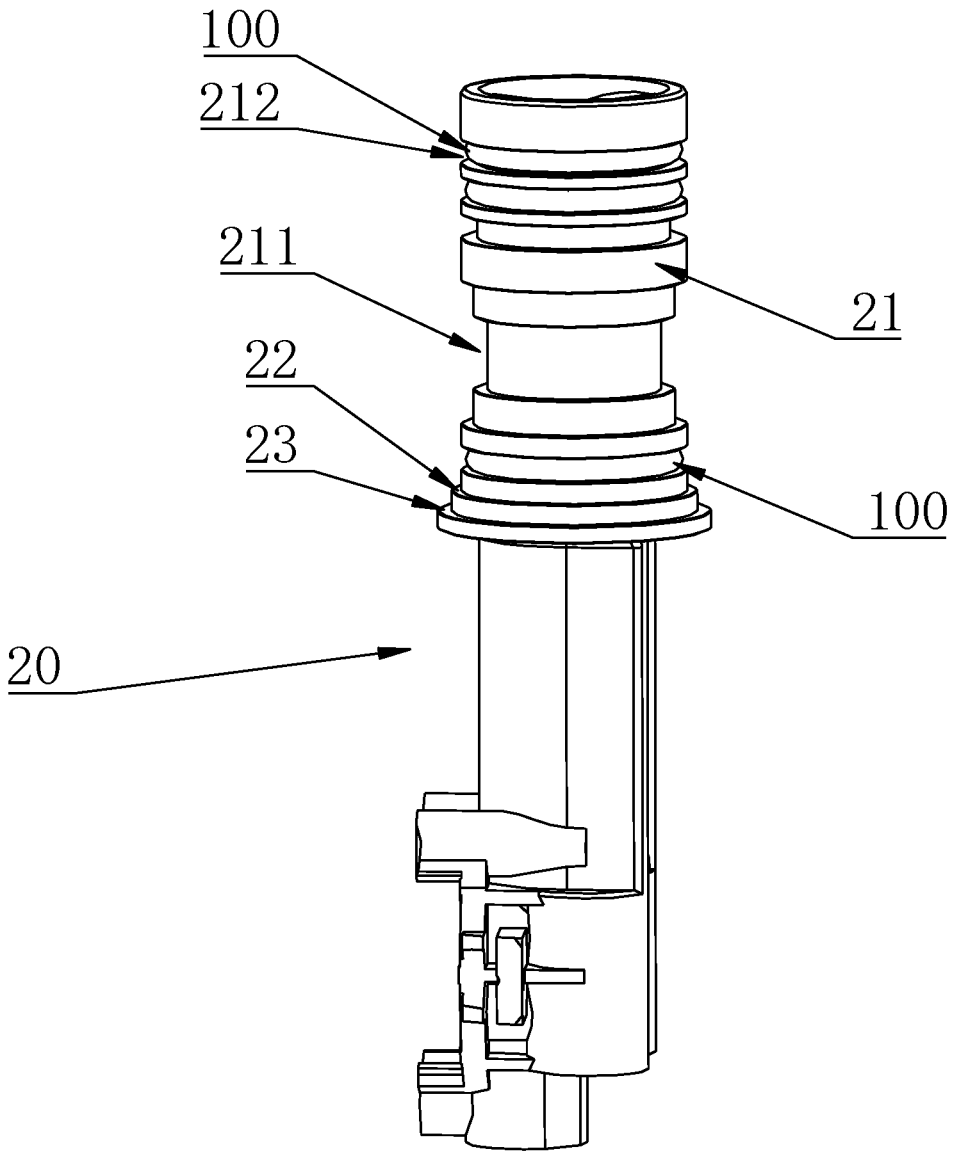
FIG. 3 is a three-dimensional structural diagram of a fixed base of an embodiment of the application.
Figure 6:
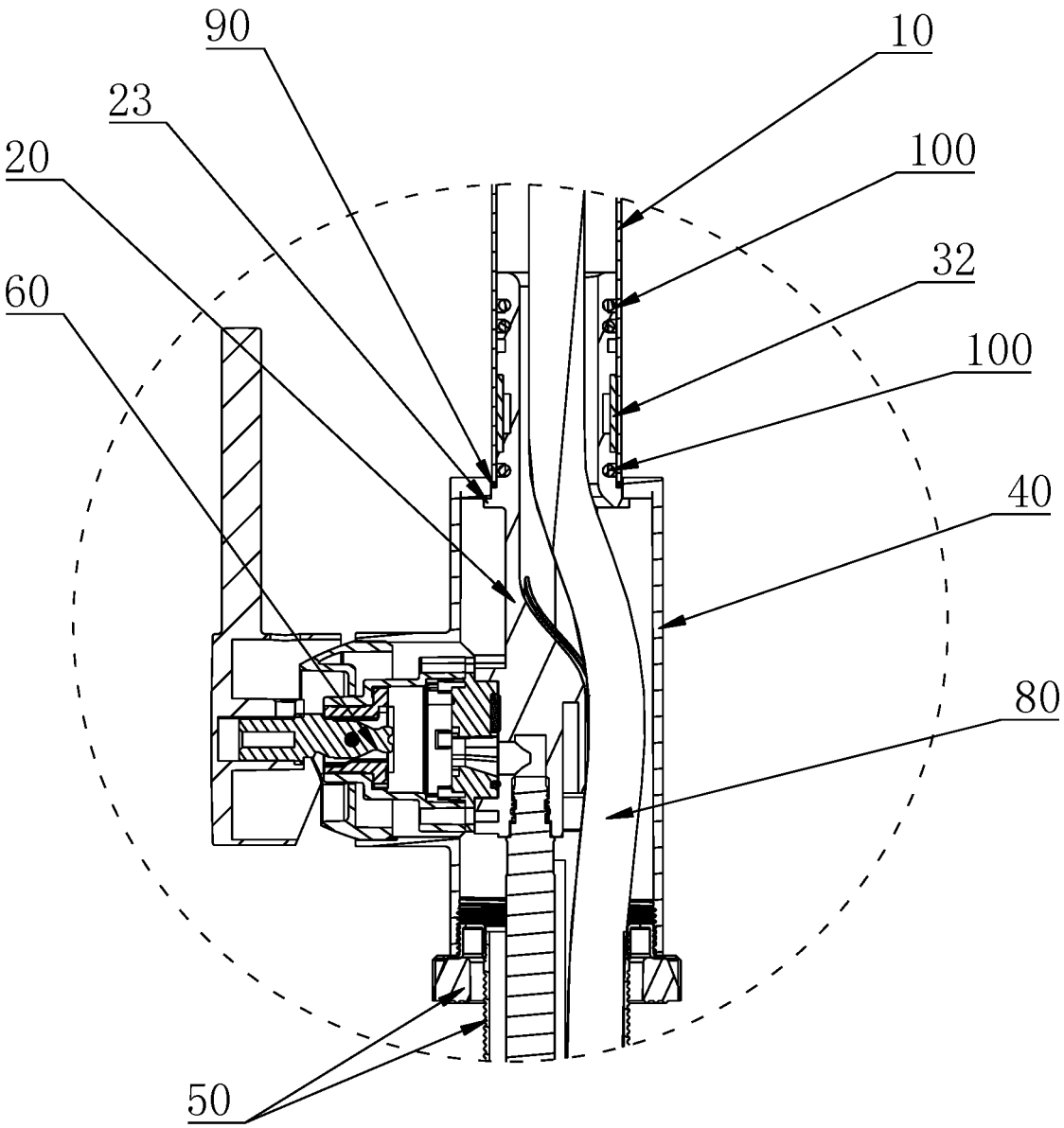
FIG. 6 is an enlarged view of portion A in FIG. 5.
Figure 7:
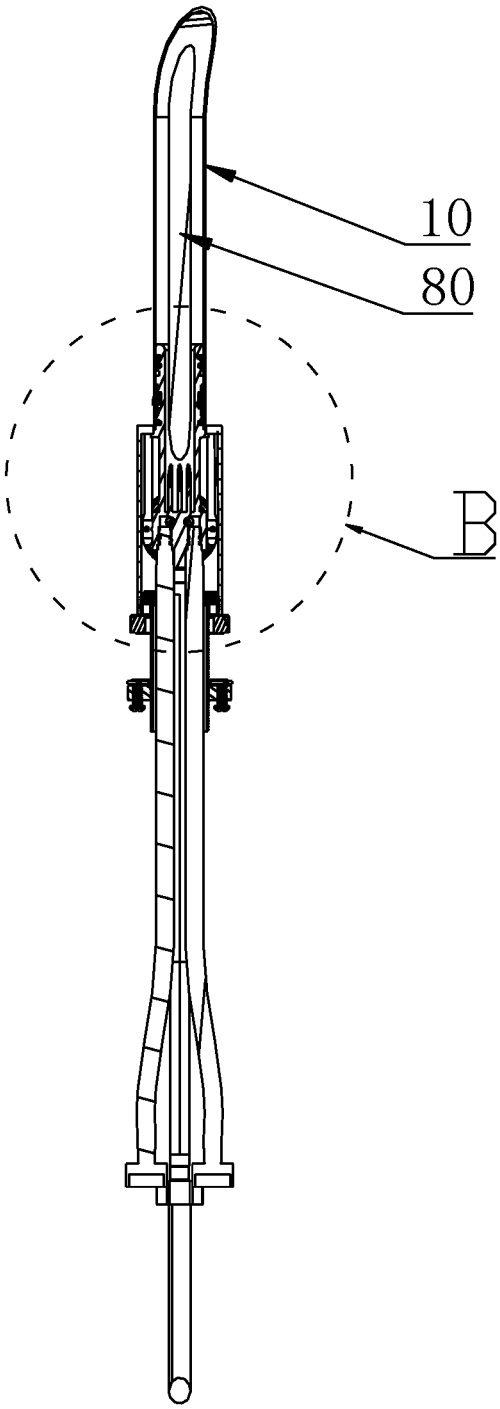
FIG. 7 is a second sectional view of an embodiment of the application.
Figure 8:
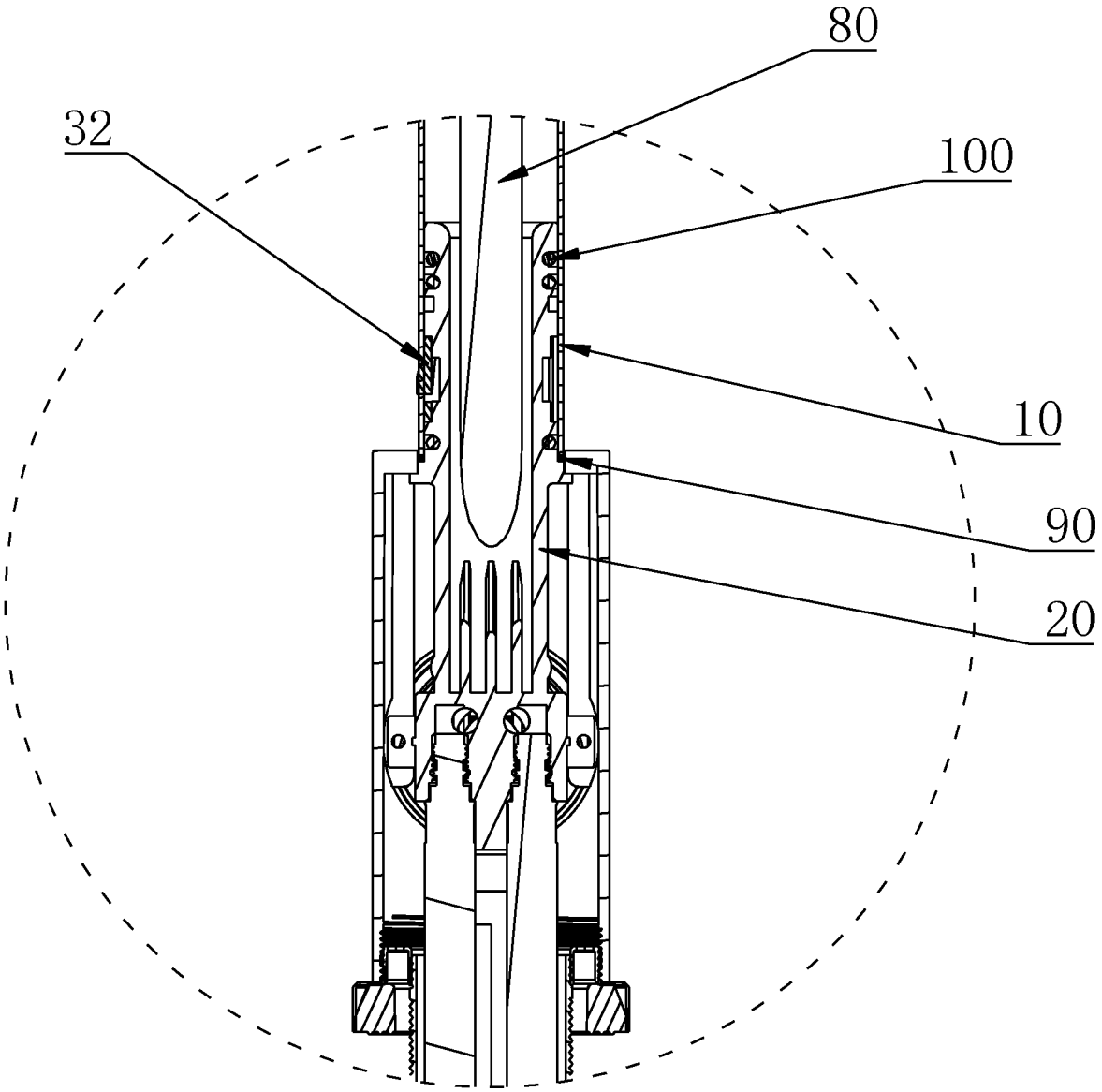
FIG. 8 is an enlarged drawing of portion B in FIG. 7 of the application.

Referring to FIG. 3, FIG. 6, and FIG. 8, in the embodiment, a position, located at the bottom end of the insertion part 21, on an outer peripheral wall of the fixed base 20 is provided with a step surface 22, a wear-resistant pad 90 is installed on the step surface 22, and an end surface of the bottom end of the elbow pipe 10 abuts against the wear-resistant pad 90. Through the arrangement of the wear-resistant pad 90, the wear of the fixed base 20 caused by the elbow pipe 10 rotating relative to the fixed base 20 is effectively avoided.

Referring to FIG. 3, FIG. 6, and FIG. 8, in the embodiment, the outer peripheral wall of the insertion part 21 of the fixed base 20 is provided with a sealing ring groove 212, a sealing ring 100 is installed on the sealing ring groove 212, and the outer peripheral wall of the insertion part 21 and an inner peripheral wall of the elbow pipe 10 are in sealing fit through the sealing ring 100. Through the arrangement of the sealing ring 100, on the one hand, the sealing between the elbow pipe 10 and the fixed base 20 is realized, and on the other hand, the hand feeling of rotating the elbow pipe 10 is better and the use experience is improved.

During assembly, the fixed base 20 is first installed into the faucet body 40, and the insertion part 21 on the fixed base 20 extends out of the through hole 41 in the faucet body 40, and the spacing ring 23 on the fixed base 20 abuts against and is limited to the edge of the inner side of the through hole 41, then the valve core of the control valve 60 and the fixed base 20 are locked, and the fixed base 20 is fixed in the faucet body 40 under the limiting of the spacing ring 23 and the locking of the valve core of the control valve 60. Then, the faucet body 40 provided with the fixed base 20 and the control valve 60 is fixed to the mounting table surface through the locking assembly 50. Finally, the elbow pipe 10 and the insertion part 21 of the fixed base 20 are inserted, and when the insertion part 21 of the fixed base 20 is inserted into the elbow pipe 10 to reach the preset position, the elastic buckle 31 of the clamping piece 30 is inserted into the clamping hole 11, so that the fixed base 20 and the elbow pipe 10 are relatively rotationally connected.

When the fixed base 20 and the elbow pipe 10 are disassembled, it is only necessary to drive the elastic buckle 31 to make the protruding column 312 of the elastic buckle 31 exit the clamping hole 11, so that the elbow pipe 10 and the fixed base 20 are easily disassembled and assembled.

Unless otherwise defined, technical and scientific terms used herein have the same meaning as commonly understood by those skilled in the art of the application. The terms used herein are only for the purpose of describing the specific implementations and are not intended to limit the application. The terms such as "part" appearing herein may represent either a single part or a combination of parts. The terms such as "install" and "set" appearing herein may represent either that a part is directly attached to another part, or that a part is attached to another part through a middle part. Features described in one implementation herein may be applied to another embodiment, either alone or in combination with other features, unless the features are not applicable in the other embodiment or otherwise stated.

The above description illustrates and describes preferred embodiments of the application, as before, it is to be understood that the application is not limited to the form disclosed herein and should not be regarded as excluding other embodiments, but can be used in a variety of other combinations, modifications and environments and can be modified within the scope of the conception of the application herein by means of the above instruction or technology or knowledge in related fields. Modifications or changes made by those skilled in the art should fall within the scope of protection of the appended claims of the application to the technical solutions without departing from the spirit and scope of the application.

What is claimed is:

1. A disassembly and assembly structure of a faucet, comprising:

an elbow pipe with both ends run through, a side wall of a bottom of the elbow pipe being provided with a clamping hole;

a fixed base, provided with an insertion part, the insertion part being inserted into the elbow pipe from an opening at a bottom end of the elbow pipe; and a clamping piece, rotationally installed on the insertion part of the fixed base, the clamping piece comprising an elastic buckle, the elastic buckle being clamped into the clamping hole when the insertion part of the fixed base is inserted into the elbow pipe to reach a preset position, and when the elbow pipe rotates relative to the fixed base, the elbow pipe actuating the clamping piece to rotate relative to the fixed base;

wherein an outer peripheral wall of the insertion part of the fixed base is provided with a sealing ring groove, a sealing ring is installed on the sealing ring groove, and the outer peripheral wall of the insertion part and an inner peripheral wall of the elbow pipe are in sealing fit through the sealing ring.

2. The disassembly and assembly structure of the faucet according to claim 1, wherein the clamping piece further comprises a C-shaped connecting ring, the outer peripheral wall of the insertion part of the fixed base is provided with an annular groove, the C-shaped connecting ring is embedded into the annular groove, the C-shaped connecting ring rotates in the annular groove, and the elastic buckle is installed on the C-shaped connecting ring.

3. The disassembly and assembly structure of the faucet according to claim 2, wherein a side wall of the C-shaped connecting ring is provided with an avoiding groove, an elastic piece is formed by a part surrounded by the avoiding groove on the side wall of the C-shaped connecting ring, an outer side of a free end of the elastic piece is provided with a protruding column matched with the clamping hole, and the elastic piece and the protruding column constitute the elastic buckle.

4. The disassembly and assembly structure of the faucet according to claim 3, wherein an inclined surface is formed on an upper surface of the protruding column, and the bottom end of the elbow pipe abuts against the inclined surface to enable the protruding column to move inward in a radial direction of the insertion part in a process of inserting the insertion part into the elbow pipe.

5. The disassembly and assembly structure of the faucet according to claim 2, wherein after the insertion part is inserted into the elbow pipe, an inner wall of the elbow pipe restricts the C-shaped connecting ring to exit the annular groove.

6. The disassembly and assembly structure of the faucet according to claim 1, further comprising a hollow faucet body, wherein a bottom end of the faucet body is fixed to a mounting table surface through a locking assembly, a top end of the faucet body is provided with a through hole, a part of the fixed base is fixed in the faucet body, and the insertion part penetrates out of the faucet body through the through hole.

7. The disassembly and assembly structure of the faucet according to claim 6, wherein a side wall of the faucet body is provided with a mounting hole configured to install a control valve, and a valve core of the control valve penetrates through the mounting hole and is connected to the fixed base.

8. The disassembly and assembly structure of the faucet according to claim 1, wherein an outlet end of the elbow pipe is provided with a drawing head, a drawing water pipe penetrates through the elbow pipe and is connected to the drawing head, the insertion part is sleeve-shaped, an upper end and a lower end of the insertion part are connected to form a channel for allowing the drawing water pipe to pass through.

9. The disassembly and assembly structure of the faucet according to claim 1, wherein a position, located at a bottom end of the insertion part, on an outer peripheral wall of the fixed base is provided with a step surface, a wear-resistant pad is installed on the step surface, and an end surface of the bottom end of the elbow pipe abuts against the wear-resistant pad.

* * * * *